US012305368B2

(12) United States Patent
Kean et al.

(10) Patent No.: US 12,305,368 B2
(45) Date of Patent: May 20, 2025

(54) MOBILE MACHINE CONTROL SYSTEM

(71) Applicant: Deere & Company, Moline, IL (US)

(72) Inventors: Michael G. Kean, Maquoketa, IA (US); Todd F. Velde, Dubuque, IA (US)

(73) Assignee: Deere &Company, Moline, IL (US)

( * ) Notice: Subject to any disclaimer, the term of this patent is extended or adjusted under 35 U.S.C. 154(b) by 231 days.

(21) Appl. No.: 16/935,501

(22) Filed: Jul. 22, 2020

(65) Prior Publication Data

US 2022/0025616 A1 Jan. 27, 2022

(51) Int. Cl.

| | |
|---|---|
| ***E02F 9/26*** | (2006.01) |
| ***E02F 3/43*** | (2006.01) |
| ***E02F 9/20*** | (2006.01) |
| *E02F 3/32* | (2006.01) |

(52) U.S. Cl.

CPC ..... *E02F 9/262* (2013.01); *E02F 3/435* (2013.01); *E02F 9/2004* (2013.01); *E02F 3/32* (2013.01)

(58) Field of Classification Search

CPC ... E02F 3/43; E02F 3/431; E02F 3/432; E02F 3/433; E02F 3/434; E02F 3/435; E02F 3/436; E02F 3/437; E02F 3/438; E02F 3/439; E02F 9/2037; E02F 9/2041; E02F 9/2045; E02F 9/2004; E02F 9/2008; E02F 9/2012

See application file for complete search history.

(56) References Cited

U.S. PATENT DOCUMENTS

| | | | | |
|---|---|---|---|---|
| 5,019,761 | A * | 5/1991 | Kraft | G05B 19/427 318/568.16 |
| 9,945,095 | B2 | 4/2018 | Arimatsu et al. | |
| 10,106,952 | B2 | 10/2018 | Iwamura et al. | |
| 2005/0027420 | A1* | 2/2005 | Fujishima | E02F 9/2045 701/50 |
| 2015/0345114 | A1* | 12/2015 | Nomura | E02F 5/025 37/379 |
| 2018/0187394 | A1* | 7/2018 | Wu | E02F 3/436 |
| 2019/0078289 | A1 | 3/2019 | Matsuyama et al. | |
| 2019/0177948 | A1* | 6/2019 | Matsuyama | E02F 3/437 |
| 2020/0232179 | A1* | 7/2020 | Sasaki | E02F 9/2041 |
| 2021/0079625 | A1* | 3/2021 | Narikawa | E02F 3/435 |

OTHER PUBLICATIONS

Wampler, Multiprocessor Control of a Telemanipulator with Optical Proximity Sensors, 1984, The International Journal of Robotics Research (Year: 1984).*

* cited by examiner

*Primary Examiner* — Russell Frejd
*Assistant Examiner* — Sara J Lewandroski
(74) *Attorney, Agent, or Firm* — Kelly, Holt & Christenson; Joseph R. Kelly

(57) ABSTRACT

A mobile machine includes a tool coupled to the mobile machine by one or more controllable linkages. The machine includes a user interface mechanism configured to receive input from an operator. The machine includes one or more controllers configured to implement surface follow logic configured to receive the input from the user interface mechanism and identify a desired movement of the tool relative to a control surface, based on the input. The one or more controllers configured to implement control signal generator logic that generates a control signal to control the one or more controllable linkages, based on the identified movement.

20 Claims, 6 Drawing Sheets

MOBILE MACHINE CONTROL SYSTEM

FIELD OF THE DESCRIPTION

The present description is related to excavators used in heavy construction. More particularly, the present description is related to a control mode in such excavators.

BACKGROUND

Hydraulic excavators are heavy construction equipment generally weighing between 3500 and 200,000 pounds. These excavators have a boom, an arm, a bucket (or attachment), and a cab on a rotating platform that is sometimes called a house. A set of tracks is located under the house and provides movement for the hydraulic excavator.

Hydraulic excavators are used for a wide array of operations ranging from digging holes or trenches, demolition, placing or lifting large objects, and landscaping. Precise excavator operation is very important in order to provide efficient operation and safety. Providing a system and method that increases excavator operational precision without significantly adding to cost would benefit the art of hydraulic excavators.

The discussion above is merely provided for general background information and is not intended to be used as an aid in determining the scope of the claimed subject matter.

SUMMARY

A mobile machine includes a tool coupled to the mobile machine by one or more controllable linkages. The machine includes a user interface mechanism configured to receive input from an operator. The machine includes one or more controllers configured to implement surface follow logic configured to receive the input from the user interface mechanism and identify a desired movement of the tool relative to a control surface, based on the input. The one or more controllers are configured to implement control signal generator logic that generates a control signal to control the one or more controllable linkages, based on the identified movement.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

Figure 1:
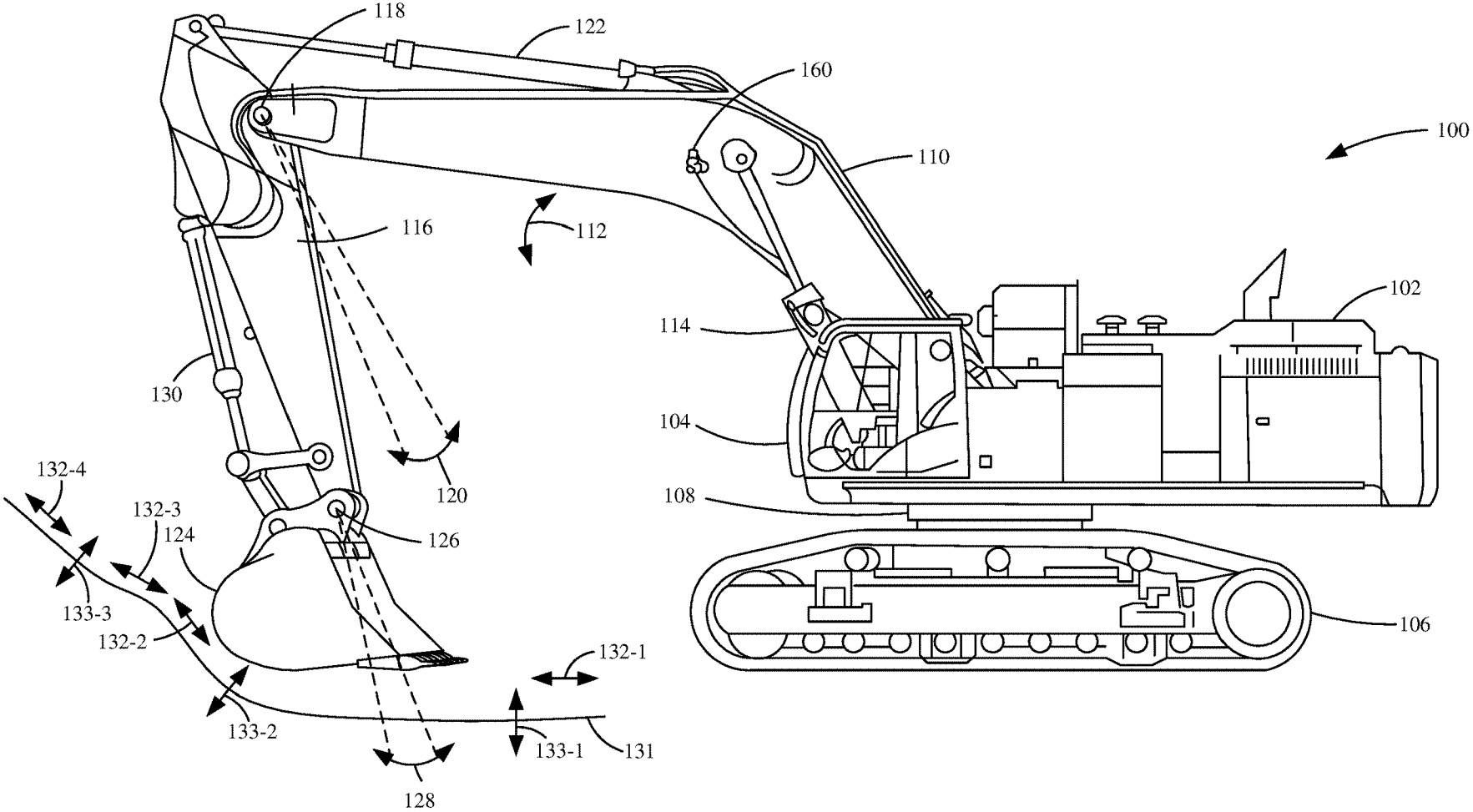
FIG. 1 is a diagrammatic view showing an example mobile machine.

FIG. 1 is a diagrammatic view showing an example machine 100 that is an excavator. Excavator or machine 100 includes a house 102 having an operator cab 104 rotatably disposed above tracked portion 106. House 102 may rotate 360 degrees about tracked portion 106 via rotatable coupling 108. A boom 110 extends from house 102 and can be raised or lowered in the direction indicated by arrow 112 based upon actuation of hydraulic cylinder(s) 114. A stick or arm 116 is pivotably connected to boom 110 via linkage pin 118 and is movable in the direction of arrows 120 based upon actuation of hydraulic cylinder 122. Bucket or tool 124 is pivotably coupled to arm 116 at linkage pin 126 and is rotatable in the direction of arrows 128 about linkage pin 126 based on actuation of hydraulic cylinder 130. In some examples, tool 124 can rotate in additional directions as well. For instance, a tiltrotor or other linkage device could be provided for additional rotation of tool 124 (or other linkages of machine 100).

A common control mode is the ISO control mode. In the ISO control mode, a left hand joystick controls the rotation of house 102 about rotatable coupling 108 (left & right) and the extension or retraction of arm 116 (e.g., away & close, represented by arrow 120), and the right hand joystick controls the lift of boom 110 (e.g., up & down, represented by arrow 112) and curl of bucket 124 (e.g., close & dump, represented by arrow 128). Inherently, because of the connections of the linkages being pivoted about a linkage pin, the movement of the linkages will be circular about the linkage pin. For bucket 124 to move in a non-circular path, the operator must utilize the joysticks in multiple directions simultaneously.

In an alternative control mode, actuation of a joystick along one axis moves bucket 124 (via control of bucket 124 and the other linkages) in a first direction parallel to surface 131 (e.g., an X-axis relative to surface 131 and away from house 102). Another actuation of a joystick along another axis moves bucket 124 (via control of bucket 124 and the other linkages) in a second direction parallel to surface 131 and perpendicular to the first direction (e.g., the Y-axis relative to surface 131 and perpendicular to boom 110). Examples of parallel movements are represented by arrows 132-1, 132-2, 132-3 and 132-4. This movement of bucket 124 parallel or substantially parallel to surface 131 can be referred to as the feed rate. Actuation of one of the joysticks in another axis actuates bucket 124 in a direction perpendicular or substantially perpendicular to surface 131 (e.g., a normal of the surface 131). Examples of perpendicular movement to surface 131 are represented by arrows 133-1, 133-2 and 133-2. As can be seen, perpendicular movement is dependent on the location of bucket 124 along control surface 131 or along a path parallel to control surface 131. Lastly, actuation a joystick in another axis controls the angle at which bucket 124 is oriented relative to surface 131. For instance, bucket 124 may be curled such that it is cutting into surface 131 or extended such that the cutting edge of bucket 124 scrapes or grades surface 131. As shown, machine 100 is an excavator, however, the systems and methods described herein can be used on other types of machines as well.

Figure 2:
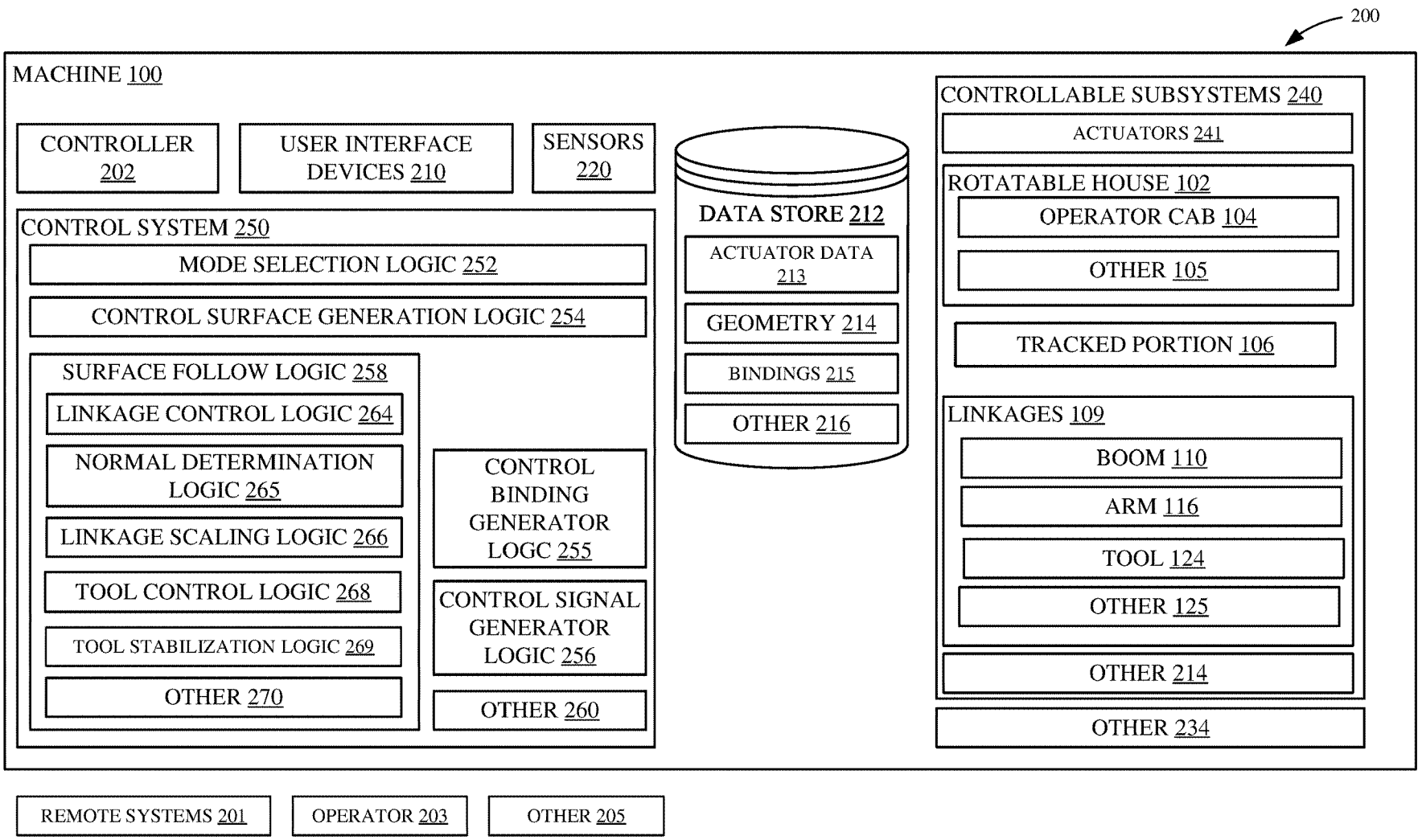
FIG. 2 is a block diagram showing an example mobile machine.

FIG. 2 is a block diagram showing example machine 100 in an example environment 200. Environment 200 includes machine 100, remote systems 201, operator 203 and can include other items as well, as indicated by block 205. Remote systems 201 can include a wide variety of systems such as other mobile machines, servers, computers, mobile electronic devices, etc. Remote systems 201 can communicate with machine 100 and other components via various network protocols e.g., Bluetooth, Wi-Fi, cellular data, LAN, WAN, etc. Some blocks representing subcomponents of other components can be disposed, in their entirety or partially, at other locations in environment 200.

Machine 100 includes controllers and/or processors 202, user interface devices 210, data store 212, sensors 220, controllable subsystems 240 and control system 250 and can include other items as well, as indicated by block 234. Controllers and processors 202 can include processors, servers and other hardware, software and combinations thereof. Controller and processors 202 implement the logic components of control system 250.

User interface devices 210 include devices that operator 203 uses to interact with machine 100. For example, interface devices 210 can include joysticks. Of course, user interface devices 210 can include other items as well, such as touch screens, pedals, steering wheels, handheld controllers, etc. In some examples, user interface devices 210 are disposed on a remote system 201 that is a mobile device.

Controllable subsystems 240 include actuators 242, rotatable house 102, tracked portion 106, linkages 109 and can include other items as well, as indicated by block 214. Rotatable house 102 rotates about tracked portion 106. Rotatable house 102 includes operator cab 104 where an operator 203 sits while controlling machine 100. Rotatable house 102 can include other items as well, as indicated by block 105. For instance, rotatable house 102 includes an engine that powers machine 100. Tracked portion 106 includes the tracks that propel machine 100 about a worksite. Linkages 109 include boom 110, arm 116, tool 124 and can include other items as well, as indicated by block 125. Linkages 109 allow machine 100 a wide variety of control of a working environment. As shown, tool 124 is a bucket. However, tool 124 can include a variety of different attachments as well, for example, a packer.

Machine 100 includes controller 202, user interface devices 210, data store 212, sensors 220, sensor position determination logic 230, controllable subsystems 240, control system 250 and can include other items as well, as indicated by block 234. Illustratively, the components are part of machine 100, however, some of the shown blocks may be located remotely from machine 100 (e.g., on a remote server, on a different machine, etc.).

Controller 202 is configured to receive one or more inputs and perform a sequence of programmatic steps to generate one or more suitable machine outputs for controlling the operation of machine 100 (e.g., implementing the various logic components). Controller 202 may include one or more microprocessors, or even one or more suitable general computing environments as described below in greater detail. Controller 202 is coupled to user interface devices 210 in order to receive machine control inputs from an operator within cab. Examples of operator inputs include joystick movements, pedal movements, machine control settings, touch screen inputs, etc. Additionally, user interface devices 210 also include one or more operator displays in order to provide information regarding excavator operation to the operator.

Data store 212 stores various information for the operation of machine 100. As shown, data store 212 includes actuator data 213, machine geometry 214 and bindings 215, but can include other items as well, as indicated by block 216. Actuator data 213 includes various information on actuators 242 that actuate controllable subsystems 240. For instance, actuator data 213 includes data indicative of the max torque, acceleration, speed, etc. that actuators 242 actuate controllable subsystem 240. Since the characteristics of actuators 242 can be different based on the pose of machine 100, actuator data 213 can include pose-specific or other specific data as well. For example, maximum vertical acceleration of bucket 124 is less when boom 110 is lowered and arm 116 is extended than when boom 110 is raised and arm 116 is half retracted.

Geometry data 214 includes the dimensions and pivot points of the various controllable subsystems 240 of machine 100. For example, machine geometry 214 includes data indicative of the distance between the first linkage pin of boom 110 to the second linkage pin of boom 110. In some examples, geometry data 214 includes a three-dimensional model of various subcomponents of machine 100.

Bindings 215 include data indicative of controls commands that correspond to operator inputs on various interface devices 210. For instance, in a standard control mode, joystick movement in one axis raises and lowers boom 110. In an alternative control mode, joystick movement in one axis actuates various linkages 109 to move tool 124 parallel to a control path.

Sensors 220 include inertial measurement units (IMU), linkage sensors and can include a variety of other sensors as well. IMU sensors can be disposed on machine 100 at a variety of different places. For instance, IMU sensors can be placed on the rotatable house 102, boom 110, arm 116, and tool 124. IMU sensors are able to sense acceleration, orientation, rotation, displacement, etc. They are disposed on these and other components of machine 100 for precise control of machine 100. Sensors 220 also include linkage sensors which can include strain gauges, linear displacement transducers, potentiometers, etc. Linkage sensors can sense the force applied on the controllable subsystems 240 and/or the orientation of the controllable subsystems via the displacement of its actuator. For instance, boom 110 is often actuated by a hydraulic cylinder and the displacement of the piston in the cylinder will correlate to a location of boom 110 relative to rotatable house 102. In another example, a potentiometer can be located proximate a linkage pin between boom 110 and arm 116, this potentiometer will output a signal indicative of the angle between boom 110 and arm 116.

Control system 250 includes mode selection logic 252, control surface generation logic 254, control binding generator logic 255, control signal generator logic 256, surface follow logic 258, and can include other items as well, as indicated by block 260.

Mode selection logic 252 allows the operator to put machine 100 into various different control modes. Control modes enable user interface devices 210 to be bound to different control protocols. For instance, in the standard ISO or SAE control modes disclosed above, the joystick user interface devices 210 control the actuators coupled to boom 110, arm 116 and bucket 124. In a surface follow control mode, control of machine 100 via user interface devices 210 is relative to a control surface. For instance, actuating a joystick causes control system 250 to control machine 100 such that a portion of bucket 124 follows a control path along a control surface. Or for instance, actuating a user interface device 210 causes control system 250 to control machine 100 such that a portion of bucket 124 moves away from a control surface.

Control surface generation logic 254 generates a control surface. A control surface is typically the target or desired surface, however, examples a control surface may be a different type of surface. Control binding generator logic 256 binds user interface devices 210 into the control signals and stores the bindings as bindings 215 in data store 212.

Control signal generator logic 256 generates and sends a control signal to an actuator 242 to actuate a component of machine 100.

Surface follow logic 258 includes linkage control logic 264, normal determination logic 265, linkage scaling logic 266, tool control logic 268, tool stabilization logic 269 and can include other items as well, as indicated by block 270. Linkage control logic 264 calculates the movement of linkages 109 to maintain the parallel or perpendicular/away movement of tool 124 relative to the control surface. For example, to move tool 124 along a flat control path towards house 102 linkage control logic 264 determines boom 110 must be lifted and arm 116 retracted.

Normal determination logic 265 calculates the normal relative to the control path/control surface at a given time. The normal can be a true normal (e.g., a direction perpendicular to the slope of the control path at the given point along the control path) or can be a non-traditional normal that includes directions that merely intersect with the control path/control surface at some point. In some examples, the axis of gravity or the machine Z-axis (e.g., the axis that house 102 rotates about) can be used as the normal. In this case, if the control path/control surface had a vertical portion or near vertical, the normal could be modified as perpendicular or near perpendicular to the axis of gravity or the machine Z-axis.

Linkage scaling logic 266 determines the scaling of movement speed of the various linkages 109 relative to one another. For instance, boom 110 does not typically actuate as fast as arm 116 and tool 124. Therefore, when movement of boom 110 and another linkage 109 are made simultaneously, the movement speed of the smaller linkage must be scaled to an actuation the speed of boom 110. Linkage scaling logic 266 can scale or ramp back commands as flow and power limits of the actuators are reached. For instance, an operator may be actuating the joystick at full stroke, but the required actuators (across multiple linkages) might not be able to attain full movement speed and maintain the control path, so the maximum speed is scaled to the slowest actuator's maximum speed and the controlled tool follows the control path at its new, scaled, maximum speed. Linkage scaling logic 266 can also scale commands across dimensions. For instance, if both a parallel and a perpendicular command are issued at the same time but only one of these commands cannot be completed at the commanded speed, both dimensions of movement can be scaled (e.g., at a ratio equal to the user commanded speed) to the limited speed.

Tool control logic 268 controls the orientation of the tool 124 relative to the control surface (or the current control path parallel or substantially parallel to the control surface). The movement of tool 124 is substantially relative to the control surface however the angle of tool 124 can be adjusted relative to the surface. This is useful when tool 124 is a bucket and either a cutting, scraping, or backfilling etc. operation is desired. All of these operations would require a different angle of tool 124 relative to the control surface. When tool control logic 268 rotates tool 124 linkage control logic 264 adjusts the other linkages 109 such that an operating portion of tool 124 is on the control path (e.g., linkage control logic 264 maintains the cutting edge of a bucket 124 on the control path as bucket 124 is rotated).

Tool stabilization logic 269 stabilizes tool 124 as other components of machine 100 move. For instance, tool stabilization logic 269 keeps an operating point of bucket on a control path/surface as machine 100 moves. Tool stabilization logic 269 can also maintain an angle of tool 124 relative to the control path/surface as well. In some examples, tool stabilization logic 269 maintains the operating point of tool 124 in space as tool 124 is rotated e.g., by controlling the other linkages 109 and/or rotating house 102.

Figure 3:
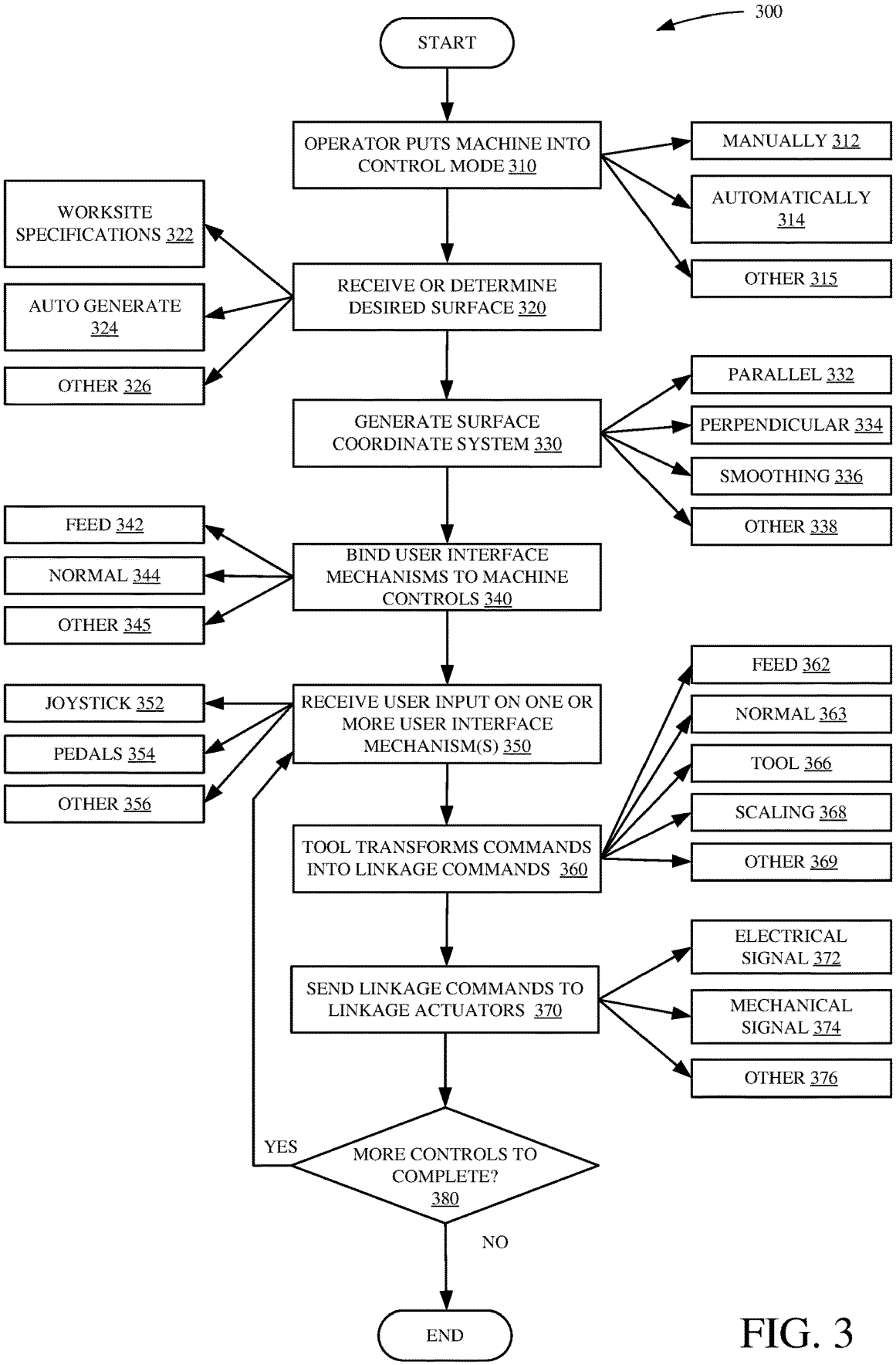
FIG. 3 is a flow diagram showing an example method of controlling a mobile machine.

FIG. 3 is a flow diagram showing an example operation 300 of controlling machine 100. Operation 300 begins at block 310 where the operator puts machine 100 into the surface follow control mode. As indicated by block 312, the operator may put machine 100 into the control mode manually. For example, actuating a user interface mechanism on a touch screen that corresponds to the surface follow control mode. As indicated by block 314, machine 100 can be put into a surface follow control mode automatically. For example, machine 100 defaults to this control mode when a target surface is loaded by the operator. As indicated by block 315, machine 100 can enter the surface follow control mode in other ways as well.

Operation 300 proceeds at block 320 where a desired surface is acquired. The surface can be received from another source or generated. As indicated by block 322, the desired surface can be received from a worksite specification server or the specifications can be uploaded into machine 100 by an operator. As indicated by block 324, the desired surface can be automatically generated. For example, a flat, level, surface at a given elevation is entered and a plane is generated. Or, for example, some dimensions of a basement dig are given and the surface is generated as a topless rectangular prism. As indicated by block 326, the surface can be acquired in other ways as well.

Operation 300 proceeds at block 330 where a coordinate system is generated based on the surface from block 320. As indicated by block 332, sets of axes can be generated as parallel to the surface. As indicated by block 334, sets of control axes are defined that are perpendicular to the surface. In some examples, perpendicular to the surface includes near perpendicular axes or simply axes away from the surface. For instance, a control surface with a grade (greater than 0 degree or less than 90 degrees incline) the perpendicular axes can correspond to the gravitational or machine Z axis rather than a normal of the surface. The above axes do not necessarily have to be linear like a traditional axis. As indicated by block 336, the axes may be smoothed. For example, where two planes of a control surface meet a sharp intersection is formed, and technically this intersection does not have a normal. Accordingly, the edge can be smoothed or the normal at the edge can be calculated as an average between the intersecting planes. The coordinate system can be generated in other ways as well, as indicated by block 338.

Operation 300 proceeds at block 340 where controls are bound to machine controls. As indicated by block 342, a set of user interface controls are bound to feed movements (e.g., movements parallel/near-parallel to the control surface). As indicated by block 344, another set of user interface controls are bound to normal movements (e.g., movements perpendicular to/away from the control surface). As indicated by block 345, some of the user interface controls can be bound to other movements. For example, a set of user interface controls are bound to one or more rotations of the tool relative to the control surface.

Operation 300 proceeds at block 350 where user input is received on one or more of the user interface mechanisms. The user input can include data indicative of a tool transformation relative to the control surface. As indicated by block 352, the one or more user interface mechanism(s) include one or more joysticks. For example, there can be a joystick for an operator's left hand and a second joystick for an operator's right hand. As indicated by block 354, the one or more user interface mechanism(s) include one or more pedals. For example, there can be a pedal for an operator's left foot and a second pedal for an operator's right foot. Of course, other user interface mechanisms can be used as well, as indicated by block 356.

Operation 300 proceeds at block 360 where tool transformation commands are converted into linkage actuation commands. As indicated by block 362, a transformation command corresponding to a feed can be converted into linkage commands. For example, a transformation parallel to the surface towards machine 100 can include lifting boom 110 and retracting arm 116. As indicated by block 363, a transformation command corresponding to a normal translation can be converted into linkage commands. For example, a transformation that is up and away from the surface can include lifting boom 110 and extending arm 116. As indicated by block 366, a transformation command corresponding to a tool orientation can be converted into linkage commands. For example, a transformation on the orientation of the tool can include curling bucket 124. As indicated by block 368, a transformation command can require scaling the speeds of various linkage actuators. For instance, an actuator of arm 116 at full speed may outrun the actuator of boom 110 at full speed and cause the tool to deviate from an intended path. Accordingly, the actuator of arm 116 may be scaled back to match the speed of the actuator of boom 110. Of course, the commands can be converted into linkage commands in other ways as well, as indicated by block 369.

Operation 300 proceeds at block 370 where the linkage commands are sent to the linkage actuators. As indicated by block 372, the signal can be electric. For example, the signal is an electrical signal sent to a hydraulic valve controller. As indicated by block 374, the signal can be mechanical. For instance, a rod mechanically opens a hydraulic valve. As indicated by block 376, the linkage commands are sent in other ways as well. For example, a combination of electrical and mechanical signals can be sent to the linkage actuators.

Operation 300 proceeds at block 380 where it is determined if there are more controls to complete. If not, then operation 300 ends. If there are additional controls to complete, then operation 300 proceeds again at block 350.

Figure 4A:
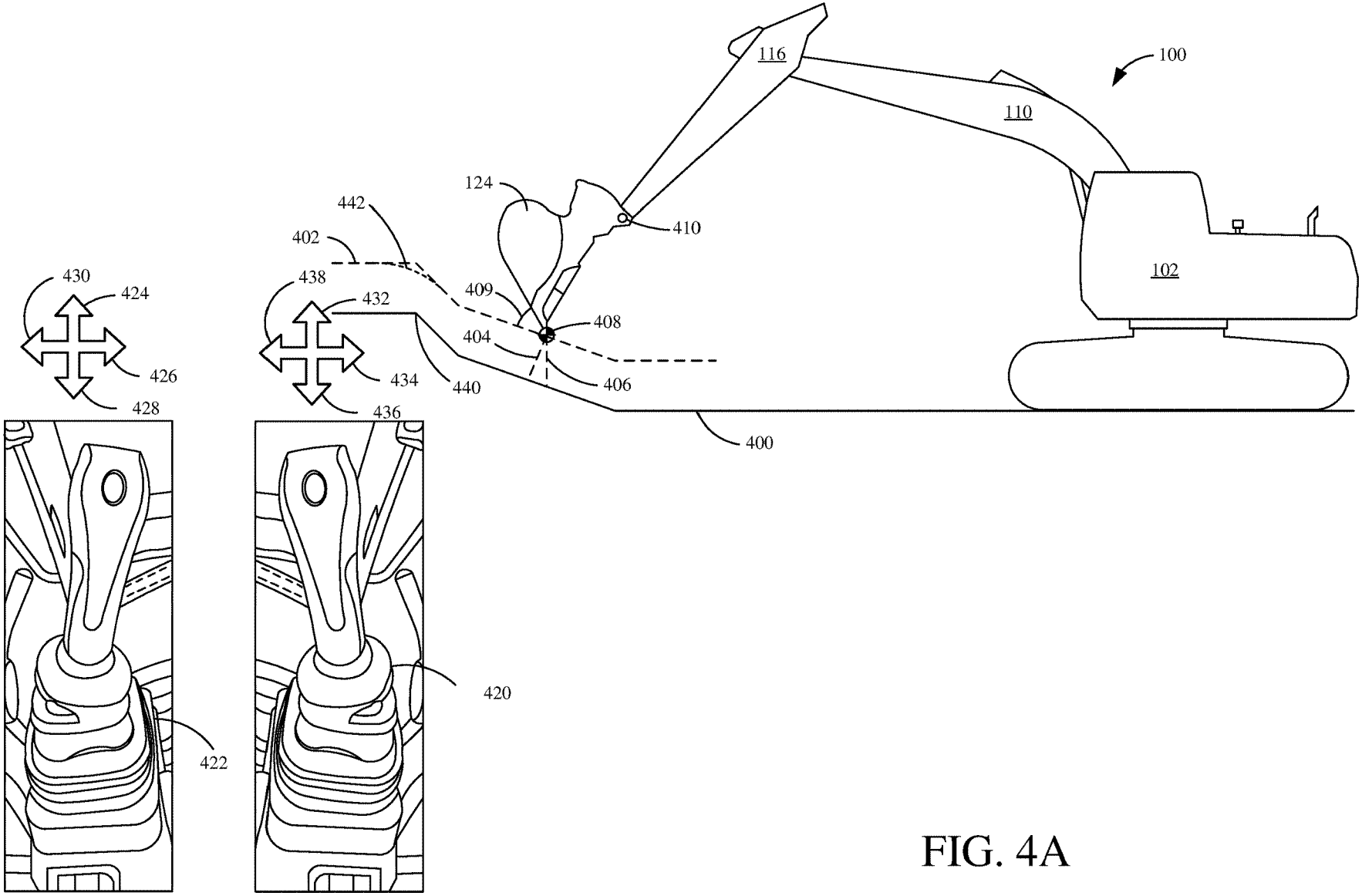
FIGS. 4A-4B are diagrams showing example control models of a mobile machine.

FIG. 4A is a diagram showing an example machine 100 executing a control command. Shown in the bottom left are two joysticks, a left joystick 422 and a right joystick 420. The operator controls various movements of machine 100 utilizing these joysticks 420, 422. As shown, bucket 124 is on a control path 402 that is parallel with, and offset from, a control surface 400. As shown, an operational point/line/plane 408 of bucket 124 follows control path 402. Operation point 408 of bucket 124 is the cutting edge of bucket 124 and is the portion of bucket 124 typically used by an operator to complete a job. In examples where the tool is not a bucket, or when a bucket is being used in other ways, the operational point 408 may be located at a different part of the tool. As shown, bucket 124 follows control path at a controlled angle 409 (e.g., the vertex of angle 409 is the operational point). This angle can be controlled to change the function of bucket 124 (e.g., from digging, to scraping or dumping). At some transition points along control path 402, angle 409 might not be sustainable, in this case angle 409 can be changed at this point to avoid another portion of bucket 124 (e.g., a portion other than operational point 408) from affecting the surface and effectively deviating from control path 402 as the portion of bucket 124 will likely displace the ground material.

Control surface 400 is a visual representation of a 3-D mesh and does represent a physical surface. However, in some examples it could correspond to a physical surface or a desired product surface. Control path 402 can be substantially parallel with control surface 400. For example, transition 440 of control surface 400 has been smoothed to smooth transition 442 of control path 402. Control path 402 is offset from a distance of line 404.

In one example, movement of joystick 422 in directions 430 and 426 causes bucket 124 and accompanying linkages to move left or right (e.g., out of the 2D plane of FIG. 4A) and parallel with control surface 400. Movement of joystick 422 in directions 424 and 428 causes bucket 124 to move along control path 402 (e.g., towards or away from machine 100). Movement of joystick 420 in directions 434 and 438 causes bucket 124 to rotate (e.g., about operating point 408 which could be fixed to control path 402 or fixed in any direction as bucket 124 rotates). Movement of joystick 420 in directions 432 and 436 moves bucket 124 in a direction away from or towards control surface 400. In one example, away from control surface 400 is directly perpendicular to control path 400, as indicated by line 404. In another example, away from control surface 400 is mapped to the axis of gravity (in the case where the path has some horizontal component), a Z-axis of machine 100, or some other dimension, as indicated by line 406.

Figure 4B:
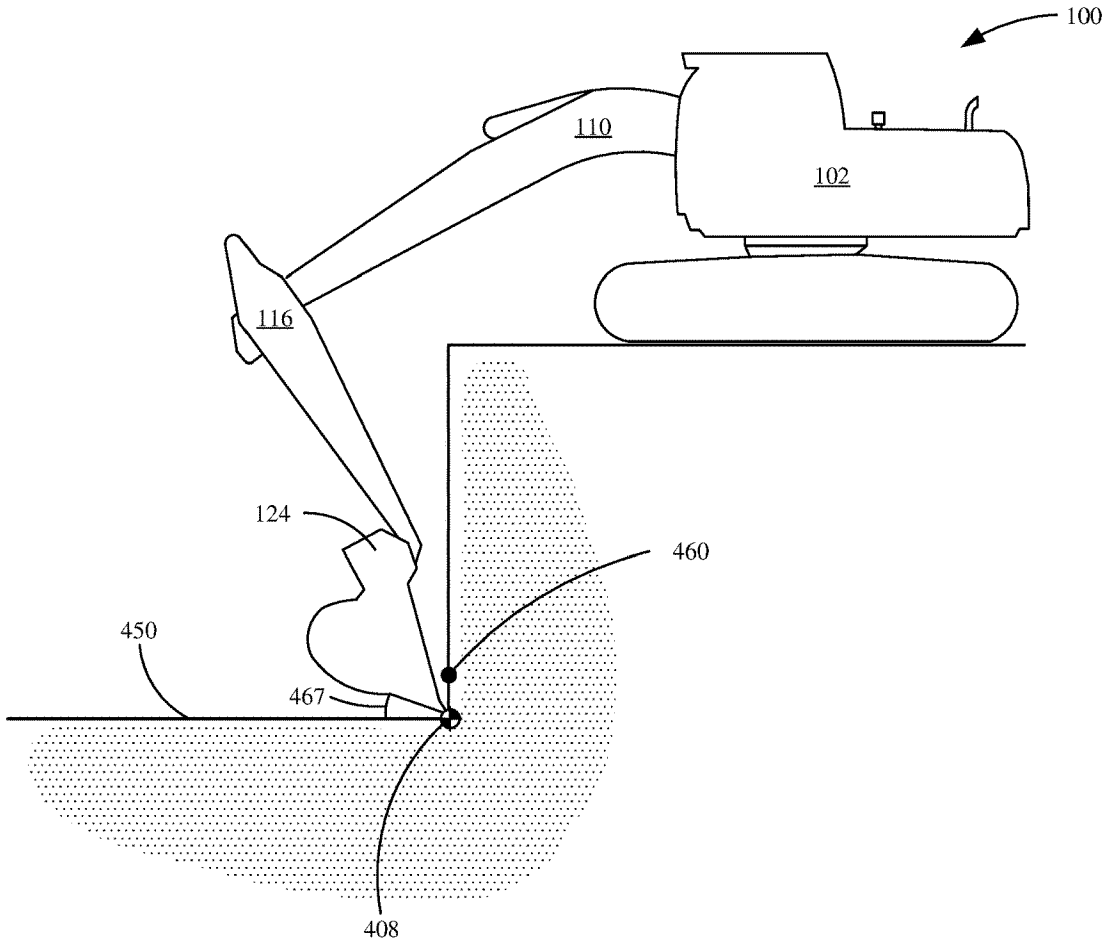
Figure 4B:
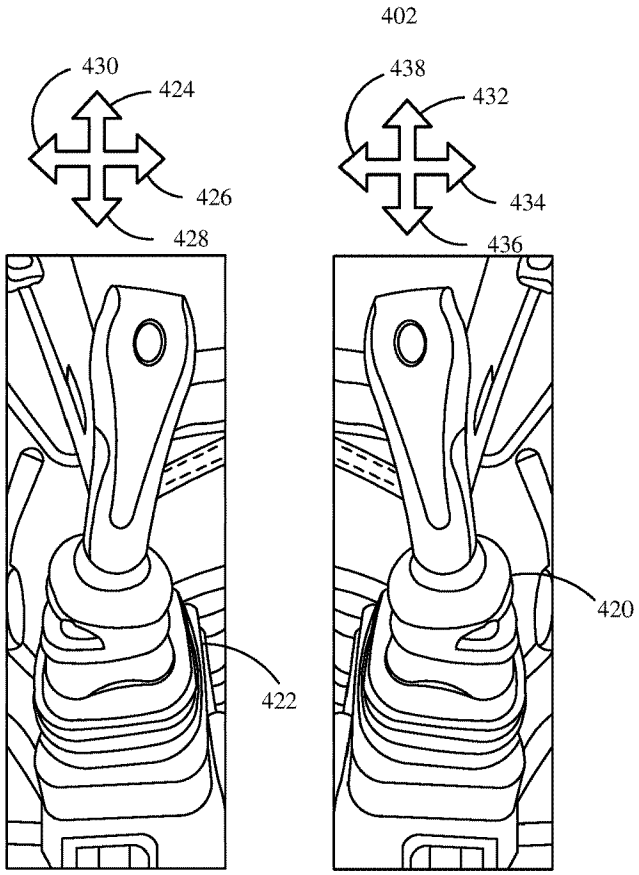

FIG. 4B is a diagram showing an example machine 100 executing a control command. Components of FIG. 4B are similar to those in FIG. 4A and similar components are similarly numbered. However, in FIG. 4B a control surface 450 replaces control surface 400. In this case, the control path and control surface 450 are the same since the operating point 408 is on control surface 450 and not offset from surface 450. Bucket 124 is at angle 467 relative to surface 450. Similar movements of joysticks 420 and 422 can move operation point 408 along control surface 450, rotate bucket 124 about operational point 408 and move bucket 124 away from control surface 450. When operational point 408 is actuated to restricted point 460 angle 467 has to be adjusted or bucket 124 will hit the bottom of the trench.

The present discussion has mentioned processors and servers. In one embodiment, the processors and servers include computer processors with associated memory and timing circuitry, not separately shown. They are functional parts of the systems or devices to which they belong and are activated by, and facilitate the functionality of the other components or items in those systems.

It will be noted that the above discussion has described a variety of different systems, components and/or logic. It will be appreciated that such systems, components and/or logic can be comprised of hardware items (such as processors and associated memory, or other processing components, some of which are described below) that perform the functions associated with those systems, components and/or logic. In addition, the systems, components and/or logic can be comprised of software that is loaded into a memory and is subsequently executed by a processor or server, or other computing component, as described below. The systems, components and/or logic can also be comprised of different combinations of hardware, software, firmware, etc., some examples of which are described below. These are only some examples of different structures that can be used to form the systems, components and/or logic described above. Other structures can be used as well.

Also, a number of user interface displays have been discussed. They can take a wide variety of different forms and can have a wide variety of different user actuatable input mechanisms disposed thereon. For instance, the user actuatable input mechanisms can be text boxes, check boxes, icons, links, drop-down menus, search boxes, etc. They can also be actuated in a wide variety of different ways. For instance, they can be actuated using a point and click device (such as a track ball or mouse). They can be actuated using hardware buttons, switches, a joystick or keyboard, thumb switches or thumb pads, etc. They can also be actuated using a virtual keyboard or other virtual actuators. In addition, where the screen on which they are displayed is a touch sensitive screen, they can be actuated using touch gestures. Also, where the device that displays them has speech recognition components, they can be actuated using speech commands.

A number of data stores have also been discussed. It will be noted they can each be broken into multiple data stores. All can be local to the systems accessing them, all can be remote, or some can be local while others are remote. All of these configurations are contemplated herein.

Also, the figures show a number of blocks with functionality ascribed to each block. It will be noted that fewer blocks can be used so the functionality is performed by fewer components. Also, more blocks can be used with the functionality distributed among more components.

Figure 5:
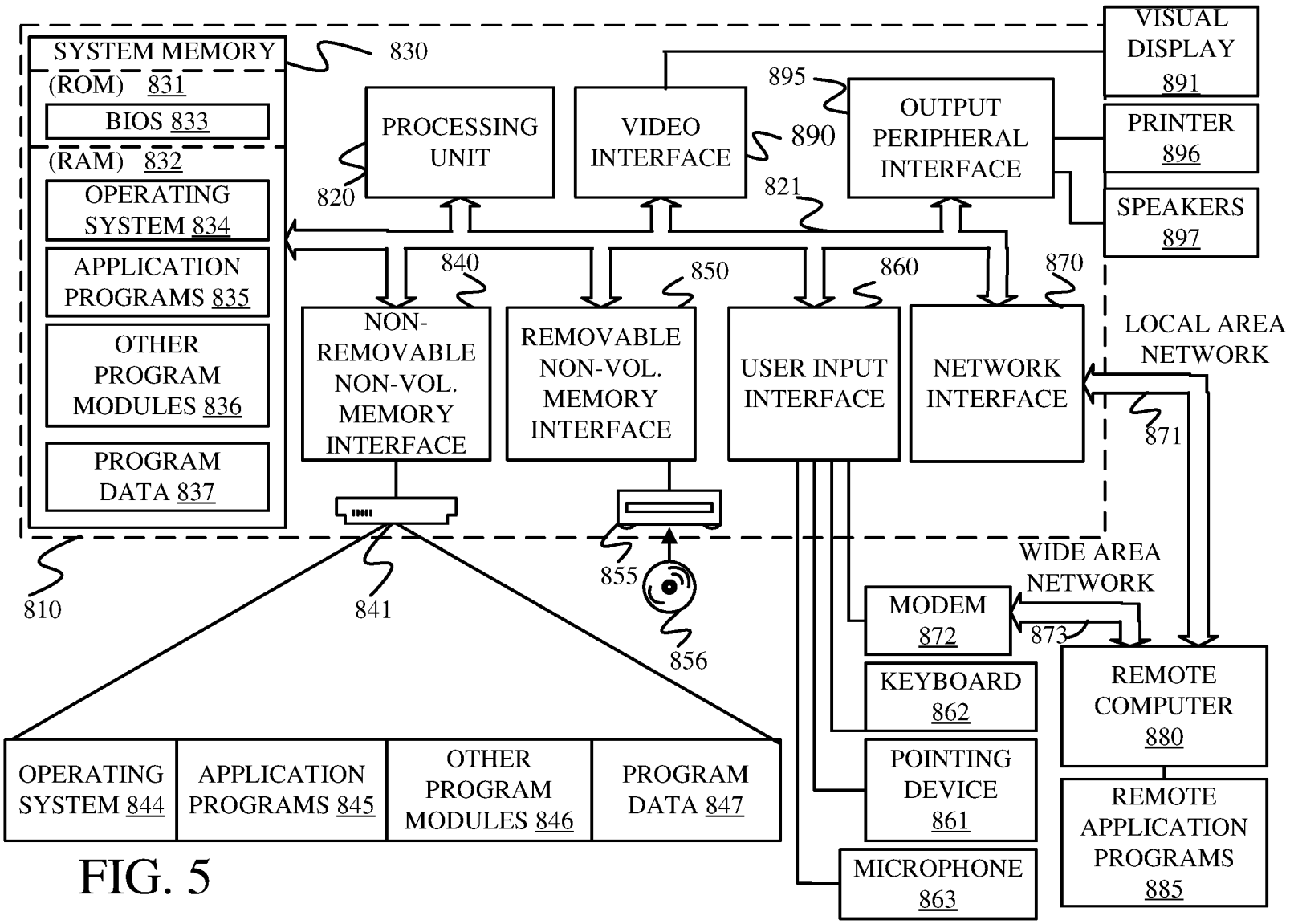
FIG. 5 is a block diagram showing an example computing system.

FIG. 5 is one embodiment of a computing environment in which elements of FIG. 2, or parts of it, (for example) can be deployed. With reference to FIG. 5, an exemplary system for implementing some embodiments includes a general-purpose computing device in the form of a computer 810. Components of computer 810 may include, but are not limited to, a processing unit 820 (which can comprise controller 202), a system memory 830, and a system bus 821 that couples various system components including the system memory to the processing unit 820. The system bus 821 may be any of several types of bus structures including a memory bus or memory controller, a peripheral bus, and a local bus using any of a variety of bus architectures. Memory and programs described with respect to FIG. 2 can be deployed in corresponding portions of FIG. 5.

Computer 810 typically includes a variety of computer readable media. Computer readable media can be any available media that can be accessed by computer 810 and includes both volatile and nonvolatile media, removable and non-removable media. By way of example, and not limitation, computer readable media may comprise computer storage media and communication media. Computer storage media is different from, and does not include, a modulated data signal or carrier wave. It includes hardware storage media including both volatile and nonvolatile, removable and non-removable media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which can be used to store the desired information and which can be accessed by computer 810. Communication media may embody computer readable instructions, data structures, program modules or other data in a transport mechanism and includes any information delivery media. The term "modulated data signal" means a signal that has one or more of its characteristics set or changed in such a manner as to encode information in the signal.

The system memory 830 includes computer storage media in the form of volatile and/or nonvolatile memory such as read only memory (ROM) 831 and random-access memory (RAM) 832. A basic input/output system 833 (BIOS), containing the basic routines that help to transfer information between elements within computer 810, such as during start-up, is typically stored in ROM 831. RAM 832 typically contains data and/or program modules that are immediately accessible to and/or presently being operated on by processing unit 820. By way of example, and not limitation, FIG. 8 illustrates operating system 834, application programs 835, other program modules 836, and program data 837.

The computer 810 may also include other removable/non-removable volatile/nonvolatile computer storage media. By way of example only, FIG. 8 illustrates a hard disk drive 841 that reads from or writes to non-removable, nonvolatile magnetic media, a magnetic disk drive 851, nonvolatile magnetic disk 852, an optical disk drive 855, and nonvolatile optical disk 856. The hard disk drive 841 is typically connected to the system bus 821 through a non-removable memory interface such as interface 840, and magnetic disk drive 851 and optical disk drive 855 are typically connected to the system bus 821 by a removable memory interface, such as interface 850.

Alternatively, or in addition, the functionality described herein can be performed, at least in part, by one or more hardware logic components. For example, and without limitation, illustrative types of hardware logic components that can be used include Field-programmable Gate Arrays (FPGAs), Program-specific Integrated Circuits (e.g., ASICs), Program-specific Standard Products (e.g., ASSPs), System-on-a-chip systems (SOCs), Complex Programmable Logic Devices (CPLDs), etc.

The drives and their associated computer storage media discussed above and illustrated in FIG. 5, provide storage of computer readable instructions, data structures, program modules and other data for the computer 810. In FIG. 5, for example, hard disk drive 841 is illustrated as storing operating system 844, application programs 845, other program modules 846, and program data 847. Note that these components can either be the same as or different from operating system 834, application programs 835, other program modules 836, and program data 837.

A user may enter commands and information into the computer 810 through input devices such as a keyboard 862, a microphone 863, and a pointing device 861, such as a mouse, trackball or touch pad. Other input devices (not shown) may include a joystick, game pad, satellite dish, scanner, or the like. These and other input devices are often connected to the processing unit 820 through a user input interface 860 that is coupled to the system bus, but may be connected by other interface and bus structures. A visual display 891 or other type of display device is also connected to the system bus 821 via an interface, such as a video interface 890. In addition to the monitor, computers may also include other peripheral output devices such as speakers 897 and printer 896, which may be connected through an output peripheral interface 895.

The computer 810 is operated in a networked environment using logical connections (such as a local area network—LAN, or wide area network WAN) to one or more remote computers, such as a remote computer 880.

When used in a LAN networking environment, the computer 810 is connected to the LAN 871 through a network interface or adapter 870. When used in a WAN networking environment, the computer 810 typically includes a modem 872 or other means for establishing communications over the WAN 873, such as the Internet. In a networked environment, program modules may be stored in a remote memory storage device. FIG. 5 illustrates, for example, that remote application programs 885 can reside on remote computer 880.

It should also be noted that the different embodiments described herein can be combined in different ways. That is, parts of one or more embodiments can be combined with parts of one or more other embodiments. All of this is contemplated herein. The flow diagrams are shown in a given order it is contemplated that the steps may be done in a different order than shown.

Example 1 is a mobile machine comprising:

a tool coupled to the mobile machine by one or more controllable linkages;

a user interface mechanism configured to receive input from an operator; and one or more controllers configured to implement:

surface follow logic configured to receive the input from the user interface mechanism and identify a desired movement of the tool relative to a control surface, based on the input; and control signal generator logic that generates a control signal to control the one or more controllable linkages, based on the identified movement.

Example 2 is the mobile machine of any or all previous examples, wherein the desired movement of the tool relative to the control surface comprises a tool movement parallel to the control surface and the control signal generator logic generates the control signal to control the one or move controllable linkages to move the tool in a direction parallel to the control surface.

Example 3 is the mobile machine of any or all previous examples, wherein the control signal generator logic generates the control signal to control the one or move controllable linkages to maintain an angle of the tool relative to the direction parallel to the control surface as the tool moves parallel to the control surface.

Example 4 is the mobile machine of any or all previous examples, wherein the desired movement of the tool relative to the control surface comprises a tool movement away from the control surface and the control signal generator logic generates the control signal to control the one or more controllable linkages to move the tool in a direction away from the control surface.

Example 5 is the mobile machine of any or all previous examples, wherein the control signal generator logic generates the control signal to control the one or move controllable linkages to move the tool in a direction perpendicular to the control surface.

Example 6 is the mobile machine of any or all previous examples, wherein the desired movement of the tool relative to the control surface comprises a tool rotation and the control signal generator logic generates the control signal to control the one or move controllable linkages to rotate the tool relative to a point on the control surface.

Example 7 is the mobile machine of any or all previous examples, wherein the control signal generator logic generates the control signal to control the one or move controllable linkages to maintain a portion of the tool at a location in space as the tool rotates, wherein the portion of the tool is a distance away from a pivot point of the tool.

Example 8 is the mobile machine of any or all previous examples, wherein the user interface mechanism comprises: one or more joysticks.

Example 9 is the mobile machine of any or all previous examples, wherein a movement of one of the one or more joysticks in one direction is indicative of a movement of the tool parallel to the control surface.

Example 10 is the mobile machine of any or all previous examples, wherein a movement of one of the one or more joysticks in a second direction is indicative of movement of the tool away from the control surface.

Example 11 is the mobile machine of any or all previous examples, wherein a movement of one of the one or more joysticks in a third direction is indicative of rotation of the tool relative to a point on the control surface.

Example 12 is a method of controlling an excavator, the method comprising:

generating a control coordinate system relative to a control surface;

receiving an input from an operator via a user interface mechanism;

mapping the input to a tool transformation on the control coordinate system; and controlling the excavator based on the tool transformation on the control surface.

Example 13 is the method of any or all previous examples, wherein the control coordinate system includes an axis parallel to the control surface and an axis perpendicular to the control surface.

Example 14 is the method of any or all previous examples, wherein the tool transformation on the control coordinate system comprises movement of a tool in the axis parallel to the control surface.

Example 15 is the method of any or all previous examples, wherein controlling the excavator comprises maintaining an angle of the tool relative to a direction of movement of the tool.

Example 16 is the method of any or all previous examples, wherein the tool transformation comprises rotating a tool; and wherein controlling the excavator comprises rotating the tool about an operating point of the tool that is separate from a linkage pin of the tool.

Example 17 is the method of any or all previous examples, wherein the operating point is on the control surface.

Example 18 is a control system for an excavator comprising:

control surface logic that receives a control surface;

user interface logic that receives user input from a joystick;

binding correlation logic that correlates the user input to a movement parallel to the control surface; and control signal generator logic that generates and sends a control signal to a controllable subsystem to move a tool based on the identified movement parallel to the control surface.

Example 19 is the control system of any or all previous examples, wherein the user interface logic receives a second user input from a second joystick and the binding correlation logic correlates the second user input to a movement away from or towards the control surface and the control signal generator logic generates and sends a second control signal to the controllable subsystem to move the tool based on the movement away from or towards the control surface.

Example 20 is the control system of any or all previous examples, wherein the user interface logic receives a second user input from a second joystick and the binding correlation logic correlates the second user input to a rotation of the tool and the control signal generator logic generates and sends a tool control signal to an actuator of the tool to move the tool based on the rotation of the tool.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A mobile machine comprising:

a tool coupled to the mobile machine by one or more controllable linkages;

a user interface mechanism configured to receive input from an operator; and one or more controllers configured to implement:

control surface generation logic configured to generate a target control surface, the target control surface comprising a target multi-planar control surface to be generated by the mobile machine;

surface follow logic configured to:

generate a three-dimensional control coordinate system comprising a plurality of sets of axes, wherein an axis of each set of axes is parallel to a respective plane of the target multi-planar control surface; and receive the input from the user interface mechanism and identify a desired movement of the tool in the three-dimensional control coordinate system referenced to the target multi-planar control surface, based on the input; and control signal generator logic that generates a control signal to control the one or more controllable linkages, based on the identified desired movement.

2. The mobile machine of claim 1, wherein the desired movement of the tool relative to the target multi-planar control surface comprises a tool movement parallel to the target multi-planar control surface and wherein the control signal generator logic generates the control signal to control the one or more controllable linkages to move the tool in a direction parallel to the target multi-planar control surface.

3. The mobile machine of claim 2, wherein the control signal generator logic generates the control signal to control the one or more controllable linkages to maintain an angle of the tool relative to the direction parallel to the target multi-planar control surface as the tool moves parallel to the target multi-planar control surface.

4. The mobile machine of claim 1, wherein the desired movement of the tool relative to the target multi-planar control surface comprises a tool movement away from the target multi-planar control surface and wherein the control signal generator logic generates the control signal to control the one or more controllable linkages to move the tool in a direction away from the target multi-planar control surface.

5. The mobile machine of claim 4, wherein the control signal generator logic generates the control signal to control the one or more controllable linkages to move the tool in a direction perpendicular to the target multi-planar control surface.

6. The mobile machine of claim 1, wherein the desired movement of the tool relative to the target multi-planar control surface comprises a tool rotation and wherein the control signal generator logic generates the control signal to control the one or more controllable linkages to rotate the tool relative to a point on the target multi-planar control surface.

7. The mobile machine of claim 6, wherein the control signal generator logic generates the control signal to control the one or more controllable linkages to maintain a portion of the tool at a location in space as the tool rotates, wherein the portion of the tool is a distance away from a pivot point of the tool.

8. The mobile machine of claim 1, wherein the user interface mechanism comprises one or more joysticks.

9. The mobile machine of claim 8, wherein a movement of one of the one or more joysticks in one direction causes a movement of the tool parallel to the target multi-planar control surface.

10. The mobile machine of claim 9, wherein a movement of one of the one or more joysticks in a second direction causes a movement of the tool away from the target multi-planar control surface.

11. The mobile machine of claim 10, wherein a movement of one of the one or more joysticks in a third direction causes a rotation of the tool relative to a point on the target multi-planar control surface.

12. A method of controlling an excavator, the method comprising:

generating a target control surface, the target control surface comprising a target multi-planar control surface to be generated by the excavator;

generating a three-dimensional control coordinate system comprising a plurality of sets of axes, wherein an axis of each set of axes is parallel to a respective plane of the target multi-planar control surface;

receiving an input from an operator via a user interface mechanism;

mapping the input to a tool transformation on the three-dimensional control coordinate system referenced to the target multi-planar control surface; and controlling the excavator based on the tool transformation on the three-dimensional control coordinate system.

13. The method of claim 12, wherein an additional axis of each set of axes is perpendicular to a respective plane of the target multi-planar control surface.

14. The method of claim 12, wherein the tool transformation on the three-dimensional control coordinate system comprises movement of a tool in a direction along the axis parallel to the target multi-planar control surface.

15. The method of claim 14, wherein controlling the excavator comprises maintaining an angle of the tool relative to a direction of movement of the tool.

16. The method of claim 12, wherein the tool transformation comprises rotating a tool; and wherein controlling the excavator comprises rotating the tool about an operating point of the tool that is separate from a linkage pin of the tool.

17. The method of claim 12, wherein the operating point is on the target multi-planar control surface.

18. A control system for an excavator comprising:

control surface logic that receives, as a target control surface, a target multi-planar control surface to be generated by the excavator;

surface follow logic that:

generates a three-dimensional control coordinate system comprising a plurality of sets of axes, wherein an axis of each set of axes is parallel to a respective plane of the multi-planar surface;

receives user input from a joystick and identifies a desired movement of a tool in the three-dimensional coordinate system referenced to the target multi-planar control surface;

binding correlation logic that correlates a first user input to a movement parallel to the target multi-planar control surface; and control signal generator logic that generates and sends a control signal to a controllable subsystem to move the tool based on the movement parallel to the target multi-planar control surface.

19. The control system of claim 18, wherein the surface follow logic receives a second user input from a second joystick and the binding correlation logic correlates the second user input to movement away from or towards the target multi-planar control surface and the control signal generator logic generates and sends a second control signal to the controllable subsystem to move the tool based on the movement away from or towards the target multi-planar control surface.

20. The control system of claim 18, wherein the surface follow logic receives a second user input from a second joystick and the binding correlation logic correlates the second user input to a rotation of the tool and the control signal generator logic generates and sends a tool control signal to an actuator of the tool to move the tool based on the rotation of the tool.

* * * * *